US011633038B2

(12) United States Patent
Xiang et al.

(10) Patent No.: US 11,633,038 B2
(45) Date of Patent: Apr. 25, 2023

(54) DESK LEG AND DESK APPLYING THE SAME

(71) Applicant: FLEXISPOT, INC., Livermore, CA (US)

(72) Inventors: Lehong Xiang, Zhejiang (CN); Fangyuan Li, Zhejiang (CN); Haikun Liu, Zhejiang (CN)

(73) Assignee: FLEXISPOT, INC., Livermore, CA (US)

( * ) Notice: Subject to any disclaimer, the term of this patent is extended or adjusted under 35 U.S.C. 154(b) by 92 days.

(21) Appl. No.: 17/474,070

(22) Filed: Sep. 14, 2021

(65) Prior Publication Data

US 2022/0087413 A1 Mar. 24, 2022

(30) Foreign Application Priority Data

Sep. 21, 2020 (CN) ..... 202022075393.6

(51) Int. Cl.
*A47B 13/06* (2006.01)

(52) U.S. Cl.
CPC ..... *A47B 13/06* (2013.01); *A47B 2200/002* (2013.01)

(58) Field of Classification Search
CPC ..... A47B 13/06; A47B 2200/002
See application file for complete search history.

(56) References Cited

U.S. PATENT DOCUMENTS 2,526,011 A * 10/1950 Ely ..... A47B 37/04 108/150
2,710,781 A * 6/1955 Haynes, Sr. ..... A47B 91/00 108/156
4,396,173 A * 8/1983 Call, Sr. ..... F16B 12/14 403/231
5,918,553 A * 7/1999 Hellwig ..... A47B 9/14 108/147.19
6,086,028 A * 7/2000 Pfister ..... A47B 21/06 108/50.01

* cited by examiner

*Primary Examiner* — Anita M King
(74) *Attorney, Agent, or Firm* — Pearne & Gordon, LLP

(57) ABSTRACT

A desk leg and a desk applying the same are provided which comprises a longitudinally-extending angular column; the column is formed by an elongated first plate piece and an elongated second plate piece connected at sides, at least one supporting piece and at least one connection hole are disposed at upper ends of inner surfaces of the first plate piece and the second plate piece respectively; the supporting piece of the upper end protrudes inwardly to support a desk board, the connection hole is located above the supporting piece, and a connection portion is disposed on the supporting pieces; and a reinforcing plate; a mounting portion corresponding to the connection portion is disposed on the reinforcing plate and detachable connected to the connection portion, which realizes a better load-bearing effect, and is convenient to transport and mount while having a larger structural strength and a longer service life.

10 Claims, 4 Drawing Sheets

DESK LEG AND DESK APPLYING THE SAME

CROSS REFERENCE TO THE RELATED APPLICATIONS

This application is based upon and claims priority to Chinese Patent Application No. 202022075393.6, filed on Sep. 21, 2020, the entire contents of which are incorporated herein by reference.

TECHNICAL FIELD

The present invention relates to the field of furniture technologies, and in particular to a desk leg and a desk applying the same.

BACKGROUND

Household tool desks are widely used in private residences and garages. The tool desk is generally supported by four columns, on which multi-layer shelves are disposed to place articles. A common tool desk usually is a wooden tool desk or an integrated plastic tool desk. However, the wooden tool desk is heavy and non-detachable, and inconvenient to assemble, and the plastic tool desk is also non-detachable and inconvenient to assemble in spite of light weight and has a weak load-bearing capacity.

SUMMARY

To effectively overcome the above defects of the prior art, an embodiment of the present invention creatively provides a desk leg, and the desk leg comprises: a longitudinally-extending angular column, where the column is formed by an elongated first plate piece and an elongated second plate piece connected at sides, at least one supporting piece and at least one connection hole are disposed at upper ends of inner surfaces of the first plate piece and the second plate piece respectively, the supporting piece of the upper end protrudes inwardly to support a desk board, the connection hole is located above the supporting piece to fixedly place the desk board on the supporting piece, and a connection portion is disposed on the supporting pieces at the upper ends of the first plate piece and the second plate piece respectively; and a reinforcing plate, where a mounting portion corresponding to the connection portion is disposed on the reinforcing plate and detachably connected to the connection portion, and the reinforcing plate is used to increase a bearing capacity of the column.

In one embodiment, the connection portion comprises a fitting slot, the mounting portion comprises a fitting piece, the fitting piece extends downwardly in a direction perpendicular to the reinforcing plate, and the reinforcing plate is detachably connected to the column by inserting the fitting piece downwardly into the fitting slot. The fitting piece is a structure integrally formed with the reinforcing plate, and the first plate piece is a structure integrally formed with the second plate piece.

In one embodiment, a widened region is disposed at least at mutually-corresponding positions of the upper ends of the first plate piece and the second plate piece respectively, the plate piece of the widened region extends outwardly in a horizontal direction, and a connection hole is disposed in the widened region to reinforce connection with a shelf.

In one embodiment, the supporting piece is a convex plate integrally formed with the first plate piece and the second plate piece respectively, at least two convex plates are disposed at the upper ends of the first plate piece and the second plate piece, and at least one of the convex plates is disposed at the bottom of the widened region of the upper end to reinforce supporting for a shelf.

In one embodiment, upper surfaces of the supporting pieces of the upper ends are located at a same horizontal plane.

In one embodiment, at least one supporting piece and at least one connection hole are disposed at a plurality of different heights of the inner surfaces of the first plate piece and the second plate piece respectively.

In one embodiment, a plurality of bulges that extend longitudinally and are arranged uniformly are disposed on the first plate piece and/or the second plate piece.

In one embodiment, a flange extending downwardly in a direction perpendicular to the reinforcing plate is disposed on the reinforcing plate.

According to another aspect, an embodiment of the present invention provides a desk. The desk comprises four desk legs and a desk board. The desk leg comprises a longitudinally-extending angular column, where the column is formed by an elongated first plate piece and an elongated second plate piece connected at sides, at least one supporting piece and at least one connection hole are disposed at upper ends of inner surfaces of the first plate piece and the second plate piece respectively, the supporting piece of the upper end protrudes inwardly to support a desk board, the connection hole is located above the supporting piece to fixedly place the desk board on the supporting piece, and a connection portion is disposed on the supporting pieces of the upper ends of the first plate piece and the second plate piece respectively. The desk leg further comprises a reinforcing plate, where a mounting portion corresponding to the connection portion is disposed on the reinforcing plate and detachably connected to the connection portion, and the reinforcing plate is used to increase a bearing capacity of the column. The desk board comprises a desktop and a side board located at the bottom of an edge of the desktop, where the side board extends downwardly in a direction perpendicular to the desktop and is placed on the supporting pieces or the reinforcing plates, a mounting hole corresponding to the connection hole is disposed on the side board, and the desk board and the columns are fixedly connected by inserting screws through the connection holes and the mounting holes.

In one embodiment, the connection portion comprises a fitting slot, the mounting portion comprises a fitting piece extending downwardly in a direction perpendicular to the reinforcing plate, and the reinforcing plate is detachably connected to the column by inserting the fitting piece downwardly into the fitting slot. The fitting piece is a structure integrally formed with the reinforcing plate, and the first plate piece is a structure integrally formed with the second plate piece.

The desk leg and the desk applying the same according to the embodiments of the present invention realize a better load-bearing effect, are convenient to transport and mount, and have a larger structural strength and a longer service life.

BRIEF DESCRIPTION OF THE DRAWINGS

By reading the following detailed descriptions with reference to the accompanying drawings, the above and other objects, features and advantages of the embodiments of the present invention will become easy to understand. In the drawings, several embodiments of the present invention are illustrated in an exemplary and non-limiting manner.

In the drawings, the same or corresponding numerals represent the same or corresponding part.

Numerals of the drawings are described as follows: 10-column, 11-second plate piece, 12-connection hole, 13-supporting piece, 14-connection portion, 15-widened region, 16-oblique supporting plate, 17-bulge, 20-reinforcing plate, 21-mounting portion, and 22-flange.

Embodiments

To make the objects, features and advantages of the present invention clearer, the technical solutions of the embodiments of the present invention will be clearly and fully described below in combination with the accompanying drawings involved in the embodiments of the present invention. Apparently, these embodiments described herein are merely some of the embodiments of the present invention rather than all embodiments. Other embodiments obtained by those skilled in the art based on these embodiments of the present invention without paying creative work will all fall within the scope of protection of the present invention.

In the descriptions of the specification, descriptions with reference to the terms such as "an embodiment", "some embodiments", "example", "specific example" or "some examples" mean specific characteristics, structures, materials or features described in combination with the embodiment or example are included in at least one embodiment or example of the present invention. Further, the described specific characteristics, structures, materials or features may be combined in any one or more embodiments or examples in an appropriate manner. In addition, those skilled in the art may combine and merge different embodiments or examples and characteristics of different embodiments or examples described in the specification in the case of no conflicts.

Further, the terms "first" and "second" are used for descriptions only and shall not be understood as indicating or implying relative importance or implicitly indicating the number of the indicated technical features. As a result, the features defined by "first" and "second" may explicitly or implicitly include at least one of the features. In the descriptions of the present invention, the term "a plurality" means two or more, unless otherwise clearly defined.

The implementations described in the following embodiments do not represent all implementations consistent with the specification. Rather, they are merely examples of methods, apparatuses or devices consistent with some aspects of the specification as detailed in the appended claims.

Figure 1:
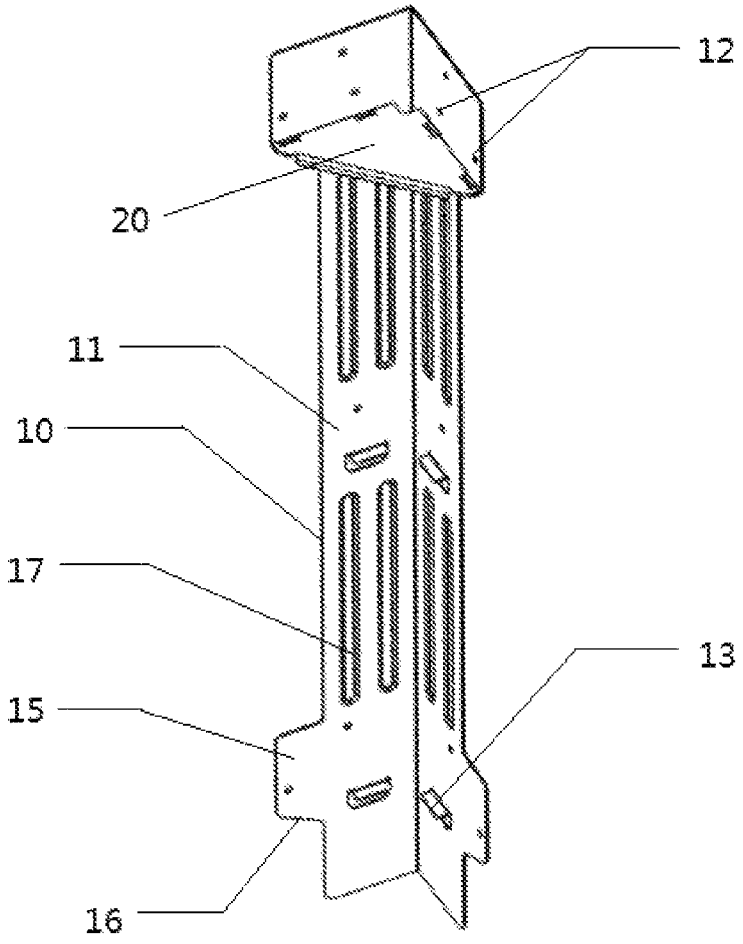
FIG. 1 is a perspective view of a desk leg according to an embodiment of the present invention.
Figure 2:
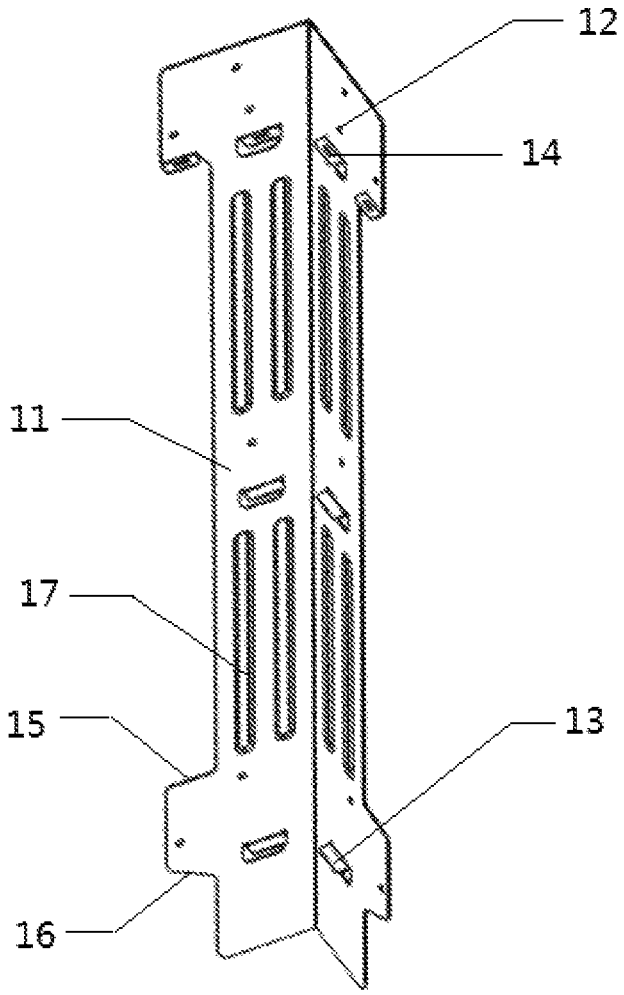
FIG. 2 is a perspective view of a partial structure of a desk leg according to an embodiment of the present invention.
Figure 3:
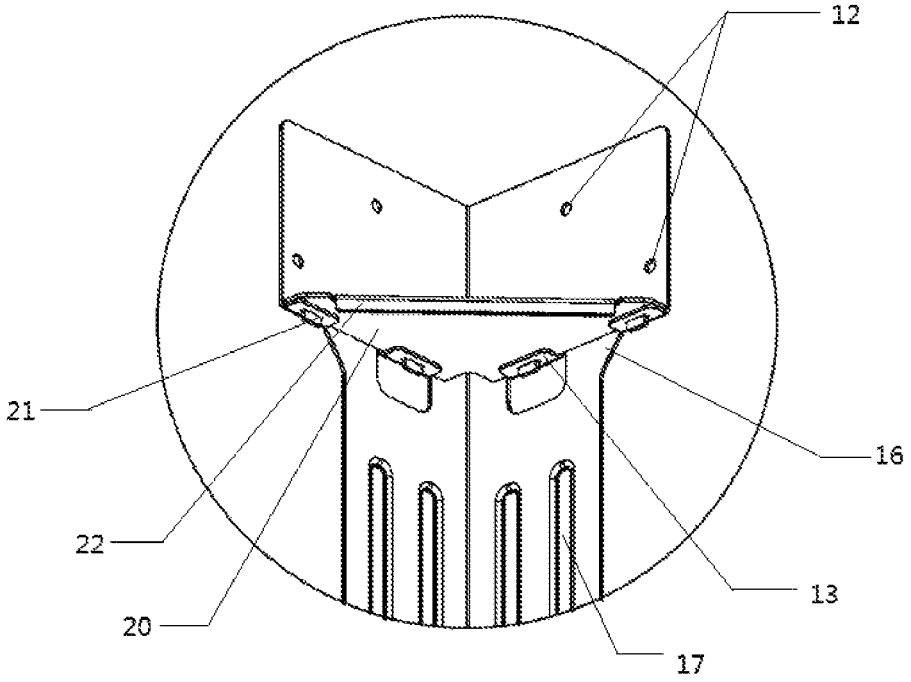
FIG. 3 is a partial enlarged view of a desk leg according to an embodiment of the present invention.
Figure 4:
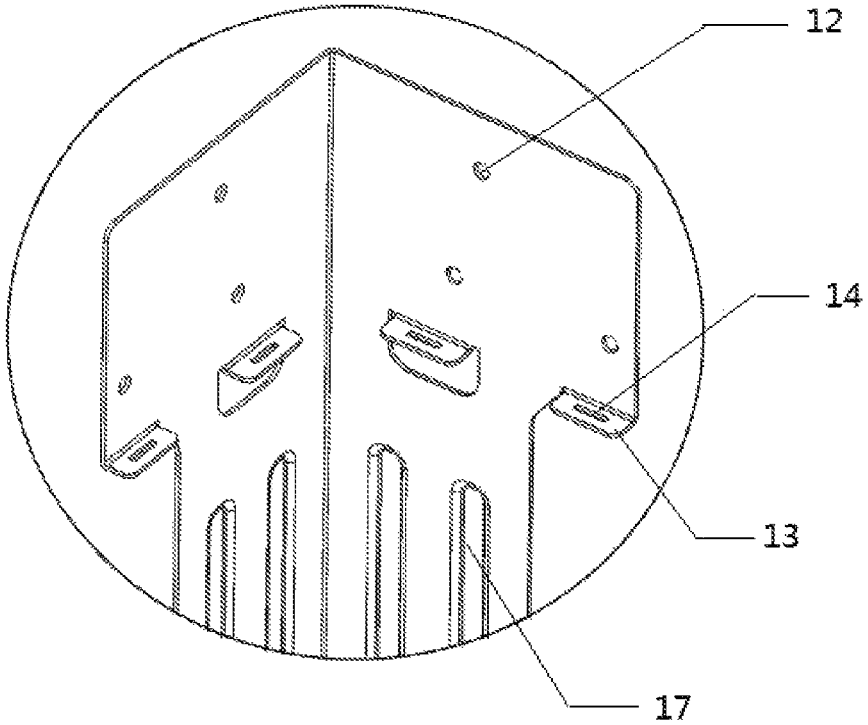
FIG. 4 is a partial enlarged view of a partial structure of a desk leg according to an embodiment of the present invention.

As shown in FIGS. 1-4, according to an aspect of embodiments of the present invention, there is provided a desk leg.

The desk leg comprises a longitudinally-extending angular column 10, the column 10 is formed by an elongated first plate piece (shown with no numeral, refer to the second plate piece) and an elongated second plate piece 11 connected at sides, the first plate piece and the second plate piece 11 include an upper end, a lower end, an intermediate portion and two sides, i.e., an inner side and an outer side respectively, at least one supporting piece 13 and at least one connection hole 12 are disposed at upper ends of inner surfaces of the first plate piece and the second plate piece 11 respectively, and the supporting piece 13 of the upper end protrudes inwardly to support a desk board. A right angle may be formed between the first plate piece and the second plate piece 11, or an acute angle or an obtuse angle may also be designed according to actual requirements. The relative angle between the first plate piece and the second plate piece 11 of the angular column 10 is not limited herein. Specifically, the supporting piece 13 may be an inverted triangular supporting block or supporting plate with a horizontal upper surface and an inclined lower surface, or a convex plate inwardly perpendicular to the column 10, or be in another specific shape or a combination of several shapes. The numbers of the supporting pieces 13 on the first plate piece and the second plate piece 11 may be same or different. The supporting pieces 13 may be disposed at the mutually-corresponding positions of the first plate piece and the second plate piece 11, or may be disposed at the incompletely-corresponding positions of the first plate piece and the second plate piece 11 according to actual mounting or design requirements. For example, the supporting pieces 13 on the first plate piece are all disposed at a first height, while the supporting pieces 13 on the second plate piece 11 are all disposed at a second height higher than the first height, so as to adapt to different heights of side boards at the front side and the left and right sides of the desk board. Further, one or more supporting pieces 13 at the first height may be disposed on the first plate piece, and a plurality of supporting pieces 13 with their heights gradually changing from the first height to the second height may be disposed on the second plate piece 11, so as to achieve an inclined mounting effect of the desk board. Certainly, the supporting pieces 13 may also be mounted in another specific manner. The specific structure and the mounting position of the supporting pieces 13 are not limited herein, as long as the supporting pieces 13 can stably support the desk board.

A connection portion 14 is disposed on the supporting pieces 13 of the upper ends of the first plate piece and the second plate piece 11 respectively. The desk leg further comprises a reinforcing plate 20, a mounting portion 21 corresponding to the connection portion 14 is disposed on the reinforcing plate 20 and detachably connected to the connection portion 14. Specifically, the connection portion 14 may include a fitting slot for insertion, and the mounting portion 21 may include a fitting piece that may be inserted into the fitting slot, such that a detachable connection between the reinforcing plate 20 and the column 10 is realized by inserting the fitting piece into the fitting slot. The connection portion 14 and the mounting portion 21 may also be screw holes with mutually-corresponding sizes and structures, such that the detachable connection can be realized by screws. Certainly, the connection portion 14 and the mounting portion 21 may also be detachable structures or other structures, which can be fitted mutually. During mounting, the reinforcing plate 20 is firstly mounted on the column 10, and then, the desk board is placed on the reinforcing plate 20, so as to increase the bearing capacity of the column 10 and prevent the first plate piece and the second plate piece 11 from being bent under pressure. The connection holes 12 are disposed above the supporting piece 13. During mounting, the desk board is placed on the reinforcing plate 20, and then, the desk board and the column 10 may be connected by inserting fasteners such as screws to further reinforce the connection of the desk board and prevent occurrence of displacement.

In one embodiment, a widened region 15 is disposed at least at mutually-corresponding positions of the upper ends of the first plate piece and the second plate piece 11 respectively, and the plate piece of the widened region 15 extends outwardly in a horizontal direction. In this case, the widened region 15 is wider than a non-widened region. A connection hole 12 is disposed in the widened region 15 to reinforce connection with a shelf and help increase a structural strength of the column 10 at a position such as the upper end which receives a larger force, so as to increase the load-bearing capacity of the column 10 and prevent the column 10 from being bent under an excessive force. In addition, a plurality of bulges 17 that extend longitudinally and are arranged uniformly may be disposed on the first plate piece and/or the second plate piece 11 to further increase the sheet metal strengths of the plate pieces.

In one embodiment, the fitting piece extends downwardly in a direction perpendicular to the reinforcing plate 20, and the reinforcing plate 20 is detachably connected to the column 10 by inserting the fitting piece downwardly into the fitting slot. The fitting piece is a structure integrally formed with the reinforcing plate 20, and the first plate piece is integrally formed with the second plate piece 11. A flange 22 extending downwardly in a direction perpendicular to the reinforcing plate 20 is disposed on the reinforcing plate 20. Specifically, the fitting piece and the flange 22 may be formed by integrally bending the reinforcing plate 20, and the connection hole 12 may be formed by integrally punching the plate piece. The supporting piece 13 is also a convex plate integrally formed with the first plate piece and the second plate piece 11 respectively. Specifically, for example, the convex plates are formed by bending the first plate piece and the second plate piece 11 respectively, at least two convex plates are disposed at the upper ends of the first plate piece and the second plate piece 11, and at least one convex plate is disposed at the bottom of the widened region 15 of the upper end to reinforce supporting for the shelf.

In a specific implementation, two angular sides of the longitudinally-extending angular column 10 are the first plate piece and the second plate piece 11 that are same and perpendicular to each other. At least one supporting piece 13 and at least one connection hole 12 are disposed at a plurality of different heights of inner surfaces of the first plate piece and the second plate piece 11, and the supporting piece 13 is a convex plate. Specifically, the connection holes 12 and the convex plates may be disposed at the upper end, the lower end and the intermediate portion respectively; the convex plates extend inwardly in a direction perpendicular to the first plate piece and the second plate piece 11 respectively and are located below the corresponding connection holes 12. The connection holes 12 are connected with the desk board by bolts or the like, and the convex plates are used to place the desk board. Thus, the bearing capacity of the supporting piece 13 can be effectively increased by bolt connection and convex plate supporting at the same time. Specifically, a plurality of connection holes 12 and convex plates may be disposed at the positions of the first plate piece and the second plate piece 11 which receive a large force, for example, at the upper ends and the lower ends of the first plate piece and the second plate piece, so as to reinforce connection with the desk board. If a heavy article is placed on the desk board, the upper ends of the first plate piece and the second plate piece 11 will receive an extremely large force. At this time, three connection holes at different positions or heights may be disposed at the upper ends of the first plate piece and the second plate piece 11 respectively. Correspondingly, a plurality of convex plates may be disposed at the upper ends of the first plate piece and the second plate piece 11 respectively. Thus, better connection and load-bearing effects can be achieved. Certainly, the connection holes 12 and the convex plates may also be disposed at other heights of the first plate piece and the second plate piece 11 according to requirements to connect more desk boards, thereby improving the mounting flexibility of the supporting pieces 13.

Further, fitting slots are also disposed on the convex plates of the upper ends of the first plate piece and the second plate piece 11. The reinforcing plate 20 further comprises a triangular plate, on two right-angle sides of which fitting pieces corresponding to the fitting slots are disposed. The fitting piece extends downwardly in a direction perpendicular to the triangular plate and may be integrally formed by bending the triangular plate. The triangular plate is detachably connected to the column 10 by inserting the fitting pieces downwardly into the fitting slots of the first plate piece and the second plate piece 11. Due to the detachable connection among the triangular plate, the first plate piece and the second plate piece 11, a plurality of first plate pieces and second plate pieces 11 and a plurality of triangular plates can be stacked respectively during transportation, thereby greatly reducing the product packaging volume, lowering the transportation costs and improving the mounting convenience. A flange 22 extending downwardly in a direction perpendicular to the triangular plate is disposed at a hypotenuse of the triangular plate to effectively increase a structural strength of the triangular plate. In an embodiment of the present invention, the flange 22 and the fitting pieces on the triangular plate are of integrated sheet metal structure, and the convex plates on the first plate piece and the second plate piece 11 are also of integrated sheet metal structure. The use of the integrated structure can effectively increase the structural strength, improve the production efficiency and lower the production costs. In one embodiment, an internal round corner may be formed at an intersection of the two right-angle sides of the triangular plate to avoid structural mounting conflict during mounting. In use, the triangular plate may be firstly inserted on the first plate piece and the second plate piece 11 to complete the mounting of the supporting pieces 13, and then, the desk board is placed on the triangular plates. Further, the first plate piece and the second plate piece 11 are connected to the desk board by inserting bolts or the like into one or more connection holes 12 disposed thereon. In an embodiment of the present invention, the desk board is placed on the triangular plates, such that the weight of the desk board is transmitted to the first plate piece and the second plate piece 11 uniformly through the triangular plate. As a result, the supporting piece 13 can achieve a better load-bearing effect while it is not easy to damage and can serve a longer time.

In one embodiment, a widened region 15 is disposed at the upper end and the lower end of each of the first plate piece and the second plate piece 11 respectively, and a plate piece of the widened region 15 extends outwardly in a horizontal direction. The upper end and the lower end generally are positions of the first plate piece and the second plate piece 11, which usually receive a large force. By disposing the widened regions 15 at the positions which usually receive a large force, the load-bearing capacities of the first plate piece and the second plate piece 11 can be effectively increased. In this case, the regions receiving a larger force are not liable to damage such as breakage whereas other regions receiving a smaller force has a smaller width, which makes the supporting pieces 13 more economical in cost and lighter in weight on the precondition of bearing the desk board weight. A lower end width of the widened region 15 gradually decreases downwardly to form a oblique supporting plate 16. By disposing a oblique supporting plate 16 region between the widened region 15 and the non-widened region, a connection structure between the widened region 15 and the non-widened region is made more stable. By disposing the oblique supporting plate 16, a force borne by the widened region 15 can be uniformly transmitted downwardly and effectively. In this way, the widened region 15 is not easily bent or cracked. In an embodiment of the present invention, the supporting piece 13 is made of a sheet metal piece which is more economical, lighter and more beautiful under the condition of same performance. To increase the sheet metal strengths of the first plate piece and the second plate piece 11, a plurality of bulges 17 that extend longitudinally and are arranged uniformly may be disposed on the first plate piece and the second plate piece 11.

Figure 5:
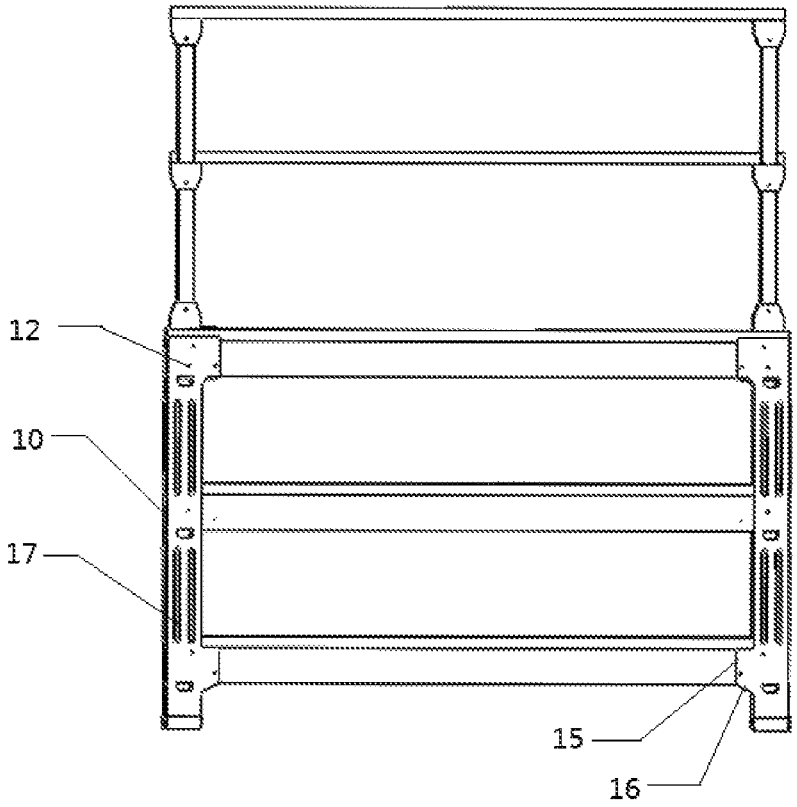
FIG. 5 is a front view of a desk according to an embodiment of the present invention.

As shown in FIGS. 1-5, according to another aspect of the embodiments of the present invention, there is provided a desk comprising the desk leg in the above embodiments. Specifically, the desk comprises: four desk legs, where the desk leg comprises a longitudinally-extending angular column 10, the column 10 is formed by an elongated first plate piece and an elongated second plate piece 11 connected at sides, at least one supporting piece 13 and at least one connection hole 12 are disposed at upper ends of inner surfaces of the first plate piece and the second plate piece 11 respectively, the supporting piece 13 of the upper end protrudes inwardly to support a desk board, the connection hole 12 is located above the supporting piece 13 to fixedly place the desk board on the supporting piece 13, and a connection portion 14 is disposed on the supporting pieces 13 of the upper ends of the first plate piece and the second plate piece 11 respectively; the desk leg further comprises a reinforcing plate 20, where a mounting portion 21 corresponding to the connection portion 14 is disposed on the reinforcing plate 20 and detachably connected to the connection portion 14, and the reinforcing plate 20 is used to increase a bearing capacity of the column 10; and a desk board, where the desk board comprises a desktop and a side board located at the bottom of an edge of the desktop, the side board extends downwardly in a direction perpendicular to the desktop and is placed on the supporting pieces 13 or the reinforcing plate 20, a mounting hole corresponding to the connection hole 12 is disposed on the side board, and the desk board and the column 10 are fixedly connected by inserting screws through the connection holes 12 and the mounting holes.

The first plate piece and the second plate piece 11 include an upper end, a lower end, an intermediate portion and two sides, i.e., an inner side and an outer side respectively, at least one supporting piece 13 and at least one connection hole 12 are disposed at the upper ends of the inner surfaces of the first plate piece and the second plate piece 11 respectively, and the supporting piece 13 of the upper end protrudes inwardly to support a desk board. A right angle may be formed between the first plate piece and the second plate piece 11, or an acute angle or an obtuse angle may also be designed according to actual requirements. Correspondingly, the desktop of the desk board may be a rectangular desktop, or another quadrilateral adaptable to the desk legs, or the like. The relative angle between the first plate piece and the second plate piece 11 of the angular column 10 and the shape of the desk board are not limited herein. Specifically, the supporting piece 13 may be an inverted triangular supporting block or supporting plate with a horizontal upper surface and an inclined lower surface, or a convex plate inwardly perpendicular to the column 10, or in another specific shape or a combination of several shapes. The numbers of the supporting pieces 13 on the first plate piece and the second plate piece 11 may be same or different. The supporting pieces 13 may be disposed at the mutually-corresponding positions of the first plate piece and the second plate piece 11, or may be disposed at the incompletely-corresponding positions of the first plate piece and the second plate piece 11 according to actual mounting or design situations. For example, the supporting pieces 13 on the first plate piece are all disposed at a first height, and the supporting pieces 13 on the second plate piece 11 are all disposed at a second height higher than the first height to adapt to different heights of side boards at a front side and left and right sides of the desk board. Furthermore, one or more supporting pieces 13 at the first height may be disposed on the first plate piece, and a plurality of supporting pieces 13 at their heights gradually changing from the first height to the second height may be disposed on the second plate piece 11, so as to achieve an inclined mounting effect of the desk board. Certainly, the supporting piece 13 may also be mounted in another specific manner, and the specific structure and the mounting position of the supporting piece 13 are not limited herein, as long as the supporting piece 13 can stably support the desk board.

A connection portion 14 is disposed on the supporting pieces 13 at the upper ends of the first plate piece and the second plate piece 11 respectively. The desk leg further comprises a reinforcing plate 20, a mounting portion 21 corresponding to the connection portion 14 is disposed on the reinforcing plate 20 and detachably connected to the connection portion 14. Specifically, the connection portion 14 may include a fitting slot for insertion, and the mounting portion 21 may include a fitting piece that may be inserted into the fitting slot. In this way, a detachable connection between the reinforcing plate 20 and the column 10 can be realized by inserting the fitting piece into the fitting slot. The connection portion 14 and the mounting portion 21 may also be screw holes with mutually-corresponding sizes and structures, such that the detachable connection is realized by screws. Certainly, the connection portion 14 and the mounting portion 21 may also be a detachable structure or another structure that can be fitted with each other. During mounting, the reinforcing plate 20 is firstly mounted on the column 10, and then, the desk board is overlapped on the reinforcing plate 20 to increase the bearing capacity of the column 10 and prevent the first plate piece and the second plate piece 11 from being bent under pressure. The connection hole 12 is disposed above the supporting piece 13. During mounting, the desk board is placed on the reinforcing plate 20, and then, the desk board and the column 10 may be connected by fasteners such as screws, so as to further reinforce the connection with the desk board and prevent occurrence of displacement.

In one embodiment, a widened region 15 is disposed at least at mutually-corresponding positions of the upper ends of the first plate piece and the second plate piece 11 respectively, and the plate piece of the widened region 15 extends outwardly in a horizontal direction, such that the widened region 15 is wider than a non-widened region. A connection hole 12 is disposed in the widened region 15 to reinforce connection with a shelf and facilitate increasing a structural strength of the column 10 at the upper end and the like which receives a larger force, so as to increase the bearing capacity of the column 10 and avoid the bending of the column 10 under an excessive force. In addition, a plurality of bulges 17 that extend longitudinally and are arranged uniformly may be disposed on the first plate piece and/or the second plate piece 11 respectively to further increase the sheet metal strengths of the plate pieces.

In one embodiment, the fitting piece extends downwardly in a direction perpendicular to the reinforcing plate 20, and the reinforcing plate 20 is detachably connected to the column 10 by inserting the fitting piece downwardly into the fitting slot. The fitting piece is a structure integrally formed with the reinforcing plate 20, and the first plate piece is a structure integrally formed with the second plate piece 11. A flange 22 extending downwardly in a direction perpendicular to the reinforcing plate 20 is disposed on the reinforcing plate 20. Specifically, the fitting piece and the flange 22 may be integrally formed by bending the reinforcing plate 20, and the connection hole 12 may be integrally formed by punching the reinforcing plate 20. The supporting piece 13 is also a convex plate integrally formed with the first plate piece and the second plate piece 11 respectively. Specifically, for example, the convex plate is formed by bending the first plate piece and the second plate piece 11 respectively, at least two convex plates are disposed at the upper ends of the first plate piece and the second plate piece 11, and at least one convex plate is disposed at the bottom of the widened region 15 of the upper end to reinforce supporting for the shelf.

In a specific implementation, two angular sides of the longitudinally-extending angular column 10 are the first plate piece and the second plate piece 11 that are same and perpendicular to each other; at least one supporting piece 13 and at least one connection hole 12 are disposed at a plurality of different heights of the inner surfaces of the first plate piece and the second plate piece 11, and the supporting piece 13 is the convex plate. Specifically, the connection hole 12 and the convex plate may be disposed at the upper end, the lower end and the intermediate portion respectively, the convex plates extend inwardly in a direction perpendicular to the first plate piece and the second plate piece 11 and are located below the corresponding connection holes 12, the connection hole 12 is connected with the desk board by bolts, or the like, and the convex plate is used to place the desk board. Thus, the bearing capacity of the supporting piece 13 can be effectively increased by bolt connection and convex plate supporting at the same time. Specifically, a plurality of connection holes 12 and convex plates may be disposed at the positions of the first plate piece and the second plate piece 11 which receive a larger force, for example, at the upper ends and the lower ends of the first plate piece and the second plate piece 11, so as to reinforce connection with the desk board. If a heavy article is placed on the desktop of the desk board, the upper ends of the first plate piece and the second plate piece 11 will receive an extremely large force. At this time, three connection holes at different positions or heights may be disposed at the upper ends of the first plate piece and the second plate piece 11 respectively. Correspondingly, a plurality of convex plates may be disposed at the upper ends of the first plate piece and the second plate piece 11 respectively. In this way, better connection and load-bearing effects can be achieved. Certainly, the connection holes 12 and the convex plates may also be disposed at other heights of the first plate piece and the second plate piece 11 according to requirements to connect more desk boards, thereby improving the mounting flexibility of the supporting piece 13.

Further, fitting slots are also disposed on the convex plates at the upper ends of the first plate piece and the second plate piece 11 respectively. The reinforcing plate 20 further comprises a triangular plate; fitting pieces corresponding to the fitting slots are disposed at two right-angle sides of the triangular plate, the fitting piece extends downwardly in a direction perpendicular to the triangular plate and may be integrally formed by bending the triangular plate, and the triangular plate is detachably connected to the column 10 by inserting the fitting pieces downwardly into the fitting slots of the first plate piece and the second plate piece 11. Due to the detachable connection among the triangular plate, the first plate piece and the second plate piece 11, a plurality of first plate pieces and second plate pieces 11 and a plurality of triangular plates can be stacked respectively during transportation, thereby greatly reducing a product packaging volume, lowering the transportation costs and improving the mounting convenience. A flange 22 extending downwardly in a direction perpendicular to the triangular plate is disposed at a hypotenuse of the triangular plate to effectively increase the structural strength of the triangular plate. In an embodiment of the present invention, the flange 22 and the fitting pieces on the triangular plate are of integrated sheet metal structure and the convex plates on the first plate piece and the second plate piece 11 are also of integrated sheet metal structure. The use of the integrated structure can effectively increase the structural strength, improve the production efficiency and lower the production costs. In one embodiment, an internal round corner may be formed at an intersection of the two right-angle sides of the triangular plate to avoid a structural mounting conflict during mounting. In use, the triangular plate may be firstly inserted on the first plate piece and the second plate piece 11 to complete the mounting of the supporting pieces 13, and then, the desk board is placed on the triangular plate. Further, the first plate piece and the second plate piece 11 are connected to the desk board by inserting bolts, or the like through one or more connection holes 12 disposed thereon. In an embodiment of the present invention, the desk board is placed on the triangular plate, so that the weight of the desk board is transmitted to the first plate piece and the second plate piece 11 more uniformly through the triangular plate. Therefore, the supporting pieces 13 can achieve the better load-bearing effect while it is not easy to damage and can serve a longer time.

In one embodiment, a widened region 15 is disposed at the upper end and the lower end of each of the first plate piece and the second plate piece 11 respectively, and a plate piece of the widened region 15 extends outwardly in a horizontal direction. The upper end and the lower end generally are positions of the first plate piece and the second plate piece 11, which usually receive a large force. By disposing the widened regions 15 at the positions which usually receive a large force, the load-bearing capacities of the first plate piece and the second plate piece 11 can be effectively increased. In this case, the regions receiving a larger force are not liable to damage such as breakage whereas other regions receiving a smaller force has a smaller width, which makes the supporting pieces 13 more economical in cost and lighter in weight on the precondition of bearing the desk board weight. A lower end width of the widened region 15 gradually decreases downwardly to form an oblique supporting plate 16. By disposing an oblique supporting plate 16 region between the widened region 15 and the non-widened region, a connection structure between the widened region 15 and the non-widened region is made more stable. By disposing the oblique supporting plate 16, a force borne by the widened region 15 can be uniformly transmitted downwardly and effectively. In this way, the widened region 15 is not easily bent or cracked. In an embodiment of the present invention, the supporting piece 13 is made of a sheet metal piece which is more economical, lighter and more beautiful under the condition of same performance. To increase the sheet metal strengths of the first plate piece and the second plate piece 11, a plurality of bulges 17 that extend longitudinally and are arranged uniformly may be disposed on the first plate piece and the second plate piece 11. A reinforcing supporting piece 13 located at a diagonal position of the desktop is also disposed at a bottom surface of the desk board.

In an embodiment of the present invention, a plurality of steps may be performed in a different order without affecting achievement of the objectives.

The above descriptions are merely specific embodiments of the present invention to which the scope of protection of the present invention is not limited. Any changes or substitutions that may easily occur to those skilled in the art in the technical scope of the present invention should fall in the scope of protection of the present invention. Therefore, the scope of protection of the present invention should be indicated as in the appended claims.

The invention claimed is:

1. A desk leg, comprising:

a longitudinally-extending angular column, wherein the column is formed by an elongated first plate piece and an elongated second plate piece connected at sides, at least one supporting piece and at least one connection hole are disposed at upper ends of inner surfaces of the first plate piece and the second plate piece respectively, the supporting piece of the upper end protrudes inwardly to support a desk board, the connection hole is located above the supporting piece to fixedly place the desk board on the supporting pieces, and a connection portion is disposed on the supporting pieces at the upper ends of the first plate piece and the second plate piece respectively; and a reinforcing plate, wherein a mounting portion corresponding to the connection portion is disposed on the reinforcing plate and detachably connected to the connection portion, and the reinforcing plate is used to increase a bearing capacity of the column.

2. The desk leg according to claim 1, wherein the connection portion comprises a fitting slot, and the mounting portion comprises a fitting piece, the fitting piece extends downwardly in a direction perpendicular to the reinforcing plate, and the reinforcing plate is detachably connected to the column by inserting the fitting pieces downwardly into the fitting slots, the fitting piece is a structure integrally formed with the reinforcing plate, and the first plate piece is a structure integrally formed with the second plate piece.

3. The desk leg according to claim 1, wherein a widened region is disposed at least at mutually-corresponding positions of the upper ends of the first plate piece and the second plate piece respectively, the plate piece of the widened region extends outwardly in a horizontal direction, and a connection hole is disposed in the widened region to reinforce connection with a shelf.

4. The desk leg according to claim 3, wherein the supporting piece is a convex plate integrally formed with the first plate piece and the second plate piece respectively, at least two convex plates are disposed at the upper ends of the first plate piece and the second plate piece respectively, and at least one of the convex plates is disposed at the bottom of the widened region of the upper end to reinforce supporting for the shelf.

5. The desk leg according to claim 1, wherein upper surfaces of the supporting pieces at the upper ends are located at a same horizontal plane.

6. The desk leg according to claim 1, wherein at least one supporting piece and at least one connection hole are disposed at a plurality of different heights of inner surfaces of the first plate piece and the second plate piece respectively.

7. The desk leg according to claim 1, wherein a plurality of bulges that extend longitudinally and are arranged uniformly are disposed on the first plate piece and/or the second plate piece.

8. The desk leg according to claim 1, wherein a flange extending downwardly in a direction perpendicular to the reinforcing plate is disposed on the reinforcing plate.

9. A desk, comprising:

four desk legs, wherein the desk leg comprises a longitudinally-extending angular column, the column is formed by an elongated first plate piece and an elongated second plate piece connected at sides, at least one supporting piece and at least one connection hole are disposed at upper ends of inner surfaces of the first plate piece and the second plate piece respectively, the supporting piece at the upper end protrudes inwardly to support a desk board, the connection hole is located above the supporting piece to fixedly place the desk board on the supporting pieces, and a connection portion is disposed on the supporting piece at the upper ends of the first plate piece and the second plate piece respectively; the desk leg further comprises a reinforcing plate, wherein a mounting portion corresponding to the connection portion is disposed on the reinforcing plate and detachably connected to the connection portion, and the reinforcing plate is used to increase a bearing capacity of the column; and a desk board, wherein the desk board comprises a desktop and a side board located at the bottom of an edge of the desktop, the side board extends downwardly in a direction perpendicular to the desktop and is placed on the supporting pieces or the reinforcing plate, a mounting hole corresponding to the connection hole is disposed on the side board, and the desk board and the column are fixedly connected by inserting screws through the connection holes and the mounting holes.

10. The desk according to claim 9, wherein the connection portion comprises a fitting slot, and the mounting portion comprises a fitting piece, the fitting piece extends downwardly in a direction perpendicular to the reinforcing plate, and the reinforcing plate is detachably connected to the column by inserting the fitting pieces downwardly into the fitting slots; the fitting piece is a structure integrally formed with the reinforcing plate, and the first plate piece is a structure integrally formed with the second plate piece.

* * * * *